US008696390B2

(12) United States Patent
Tai et al.

(10) Patent No.: US 8,696,390 B2
(45) Date of Patent: Apr. 15, 2014

(54) ELECTRICAL CONNECTOR WITH TRANSFER CONTACT FOR CONNECTING CABLE AND ANOTHER CONTACT

(75) Inventors: Hung-Chi Tai, Jhonghe (TW); Hai-Lang Wang, Taicang (CN); Zhi-Qiang Rong, Taicang (CN)

(73) Assignee: Alltop Electronics (Suzhou) Ltd., Taicang (CN)

( * ) Notice: Subject to any disclaimer, the term of this patent is extended or adjusted under 35 U.S.C. 154(b) by 7 days.

(21) Appl. No.: 13/547,844

(22) Filed: Jul. 12, 2012

(65) Prior Publication Data

US 2013/0303034 A1 Nov. 14, 2013

(30) Foreign Application Priority Data

May 10, 2012 (CN) ..... 2012 1 0143807

(51) Int. Cl.
*H01R 24/00* (2011.01)

(52) U.S. Cl.
USPC ..... 439/660

(58) Field of Classification Search
USPC ..... 439/660, 857, 752, 758, 701, 709
See application file for complete search history.

(56) References Cited

U.S. PATENT DOCUMENTS 4,915,641 A * 4/1990 Miskin et al. ..... 439/247
5,417,590 A * 5/1995 Dechelette et al. ..... 439/607.48
6,176,747 B1 * 1/2001 Rowe et al. ..... 439/721
6,347,964 B1 * 2/2002 Kuan ..... 439/680
6,783,391 B2 * 8/2004 Schlueter et al. ..... 439/540.1
7,037,142 B2 * 5/2006 Evans ..... 439/680
7,063,577 B2 * 6/2006 Fujita et al. ..... 439/701
7,070,464 B2 * 7/2006 Clark et al. ..... 439/825
7,137,848 B1 * 11/2006 Trout et al. ..... 439/465
RE41,283 E * 4/2010 Evans et al. ..... 439/680
7,726,982 B2 * 6/2010 Ngo ..... 439/79
8,323,049 B2 * 12/2012 Ngo ..... 439/552
8,366,458 B2 * 2/2013 Ngo et al. ..... 439/79
8,414,336 B2 * 4/2013 Yu et al. ..... 439/660
2003/0236035 A1 * 12/2003 Kuroda et al. ..... 439/857
2004/0253879 A1 * 12/2004 Correll et al. ..... 439/752
2008/0280496 A1 * 11/2008 Wu ..... 439/638
2008/0305682 A1 * 12/2008 Wu ..... 439/604

* cited by examiner

*Primary Examiner* — Alexander Gilman
(74) *Attorney, Agent, or Firm* — Sughrue Mion, PLLC

(57) ABSTRACT

An electrical connector (100) includes an insulative housing (10) defining a passageway (12), a contact (30) received in the passageway and a transfer contact (40) with one end connected to a cable and the other end connected to the contact. The contact includes a retaining portion (31) fixed in the passageway, a contact portion (32) extending forwardly from the retaining portion and a tail portion (33) extending backwardly from the retaining portion. The transfer contact includes a U-shaped portion (41) for receiving the tail portion (33) and a cable connection portion (42) extending from the U-shaped portion for receiving the cable. The U-shaped portion includes a pair of side walls (412). At least one of the side walls (412) includes an elastic arm (413) engaging with the tail portion (33) of the contact for improving fixation force therebetween.

18 Claims, 6 Drawing Sheets

ELECTRICAL CONNECTOR WITH TRANSFER CONTACT FOR CONNECTING CABLE AND ANOTHER CONTACT

BACKGROUND OF THE INVENTION

1. Field of the Invention

The present invention relates to an electrical connector, and more particularly to an electrical connector with a transfer contact for bridging a cable and a signal contact.

2. Description of Related Art

With rapid development of current communication and digital electronic technologies, related components need to meet the requirements of simple structures, lower cost, high assembly efficiency to improve product competitiveness. A conventional electrical connector usually includes an insulative housing and a plurality of signal contacts received in the insulative housing. When such electrical connector is mating with a mateable connector, the signal contacts usually need cables so as to establish signal transmission to the mateable connector. However, how to assemble the cables with the signal contacts is a difficult problem to those of ordinary skill in the art. Generally, current contact structures for assembling cables are complex which results in difficult assembly phenomenon, low manufacture efficiency and less-effective product competitiveness.

Hence, it is desirable to provide an electrical connector for solving the above problems.

BRIEF SUMMARY OF THE INVENTION

The present invention provides an electrical connector including an insulative housing, a contact received in the insulative housing and a transfer contact connected to the contact. The insulative housing includes a mating surface, a mounting surface opposite to the mating surface, a passageway extending through the mating surface and a rear cavity extending through the mounting surface. The passageway and the rear cavity are in communication with each other along a front-to-back direction. The contact is received in the passageway of the insulative housing. The contact includes a retaining portion fixed in the passageway, a contact portion extending forwardly from the retaining portion and a tail portion extending backwardly from the retaining portion. The transfer contact includes a U-shaped portion for receiving the tail portion and a cable connection portion extending from the U-shaped portion for receiving a cable. The U-shaped portion includes a bottom wall and a pair of side walls extending from the bottom wall and jointly with the bottom wall to define a receiving slot to receive the tail portion of the contact. At least one of the side walls includes an elastic arm protruding into the receiving slot, and the elastic arm engages with the tail portion of the contact for improving fixation force therebetween.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

Figure 1:
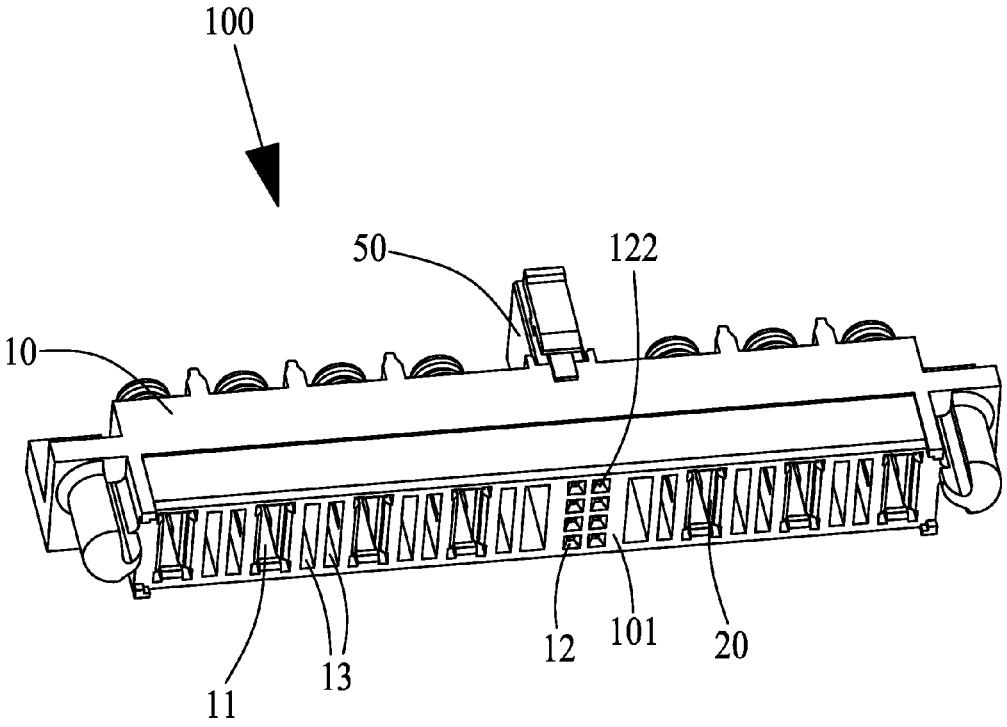
FIG. 1 is a perspective view of an electrical connector in accordance with an illustrated, embodiment of the present invention.
Figure 2:
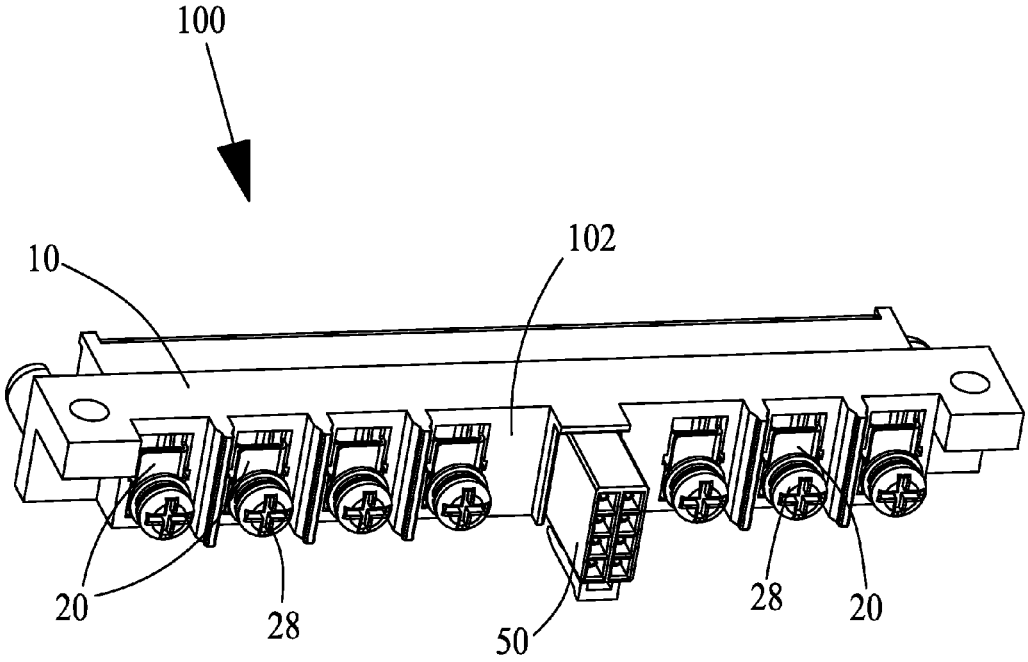
FIG. 2 is another perspective view of the electrical connector as shown in FIG. 1, taken from a different aspect.
Figure 3:
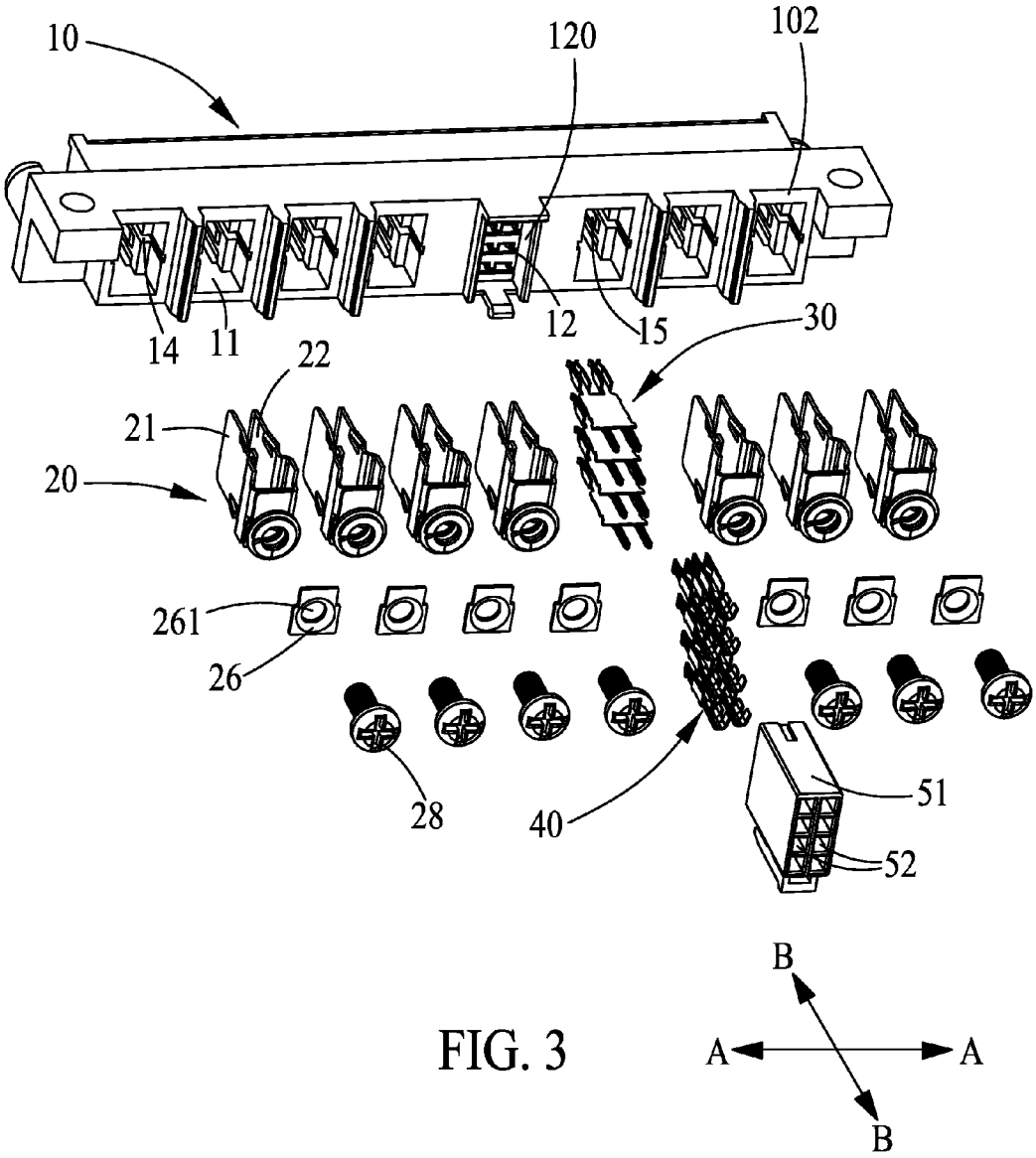
FIG. 3 is an exploded view of the electrical connector as shown in FIG. 2.

Reference will now be made to the drawing figures to describe the preferred embodiment of the present invention in detail. As shown in FIGS. 1 to 3, the illustrated embodiment of the present invention discloses an electrical connector 100, also known as a power connector, including an insulative housing 10, a plurality of power contact groups 20 retained in the insulative housing 10, a plurality of fastening members 28 for securely fastening the power contact groups 20 to insulative housing 10, a plurality of signal contacts 30 and a transfer terminal module 50 connecting with the signal contacts 30.

Referring to FIGS. 1 to 4, the insulative housing 10 extends along a longitudinal direction A-A and includes a front mating surface 101, a rear mounting surface 102, a plurality of rectangular grooves 11 extending through the mating surface 101 and the mounting surface 102 for receiving the power contact groups 20, a plurality of passageways 12 extending through the mating surface 101 for receiving the signal contacts 30, and a rear cavity 120 extending through the mounting surface 102 for at least partly receiving the transfer terminal module 50. The passageways 12 and the rear cavity 120 are in communication with each other along a front-to-back direction B-B perpendicular to the longitudinal direction A-A. As shown in FIG. 5, each passageway 12 includes a flat slot 121 and a pair of rectangular mating holes 122 below while in communication with the flat slot 121. The mating holes 122 extend through the mating surface 101 and are arranged in a matrix manner. The first slot 121 and the pair of mating holes 122 jointly receive the signal contacts 30.

Figure 4:
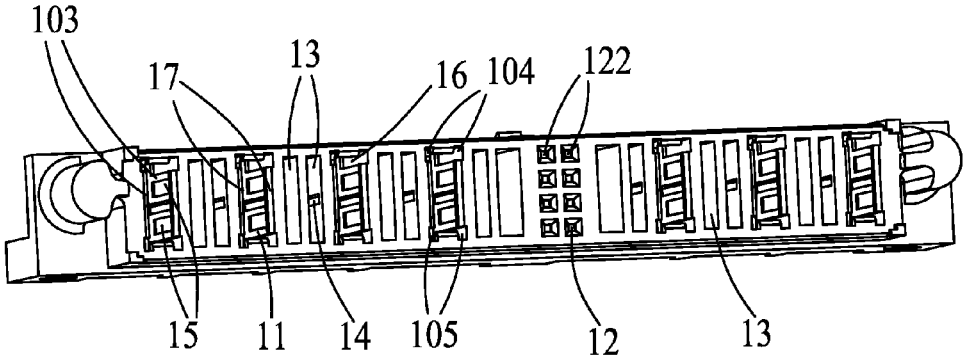
FIG. 4 is a front perspective view of an insulative housing of the electrical connector.
Figure 5:
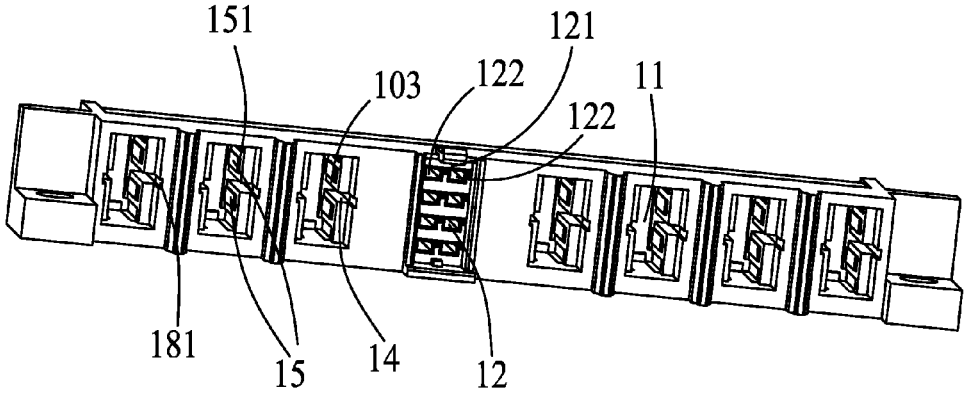
FIG. 5 is a rear perspective view of the insulative housing of the electrical connector.

As shown in FIGS. 1 to 4, corresponding to each groove 11, the insulative housing 10 includes a pair of guiding blocks 17 extending thereinto. The guiding blocks 17 are located adjacent to the mating surface 101 of the insulative housing 10 and are adapted for not only guiding insertion of a corresponding contact of a mateable connector (not shown), but also preventing the power contact groups 20 from being over-inserted into the grooves 11 along a back-to-front direction. Each groove 11 is formed between a pair of inner side walls 103 of the insulative housing 10. Each inner side wall 103 includes a pair of blocks 15 protruding into the groove 11. The pair of blocks 15 are vertically symmetrical with each other along a middle line (not shown) therebetween. Each block 15 includes an inclined surface 151 in order to form a relative greater heat-dissipation gap (not shown) with respect to the corresponding power contact group 20. Besides, as shown in FIG. 4, the insulative housing 10 defines a pair of upper positioning slots 104 and a pair of lower positioning slots 105 located at a top side and a bottom side of each groove 11, respectively. The upper positioning slots 104 and the lower positioning slots 105 are in communication with corresponding groove 11 therebetween. The upper positioning slots 104 and the lower positioning slots 105 are in communication with corresponding heat-dissipation gap for better dissipating the heat which is generated from the power contact groups 20.

Besides, in order to achieve robust heat-dissipation effects, the insulative housing 10 further defines a plurality of escaping holes 13 extending through the mating surface 101 under condition that two escaping holes 13 are positioned between each adjacent two grooves 11. Each inner side wall 103 defines a heat-dissipation slot 14 in communication with adjacent groove 111 and the adjacent escaping hole 13. Furthermore, as shown in FIG. 5, each inner side wall 103 defines a heat-dissipation slit 181 extending through the mounting surface 102 of the insulative housing 10. The heat-dissipation slit 181 and the heat-dissipation slot 14 are in communication with the corresponding groove 11 as a result that the heat generated from the power contact groups 20 can be emitted immediately.

Referring to FIGS. 4 to 7, each power contact group 20 is U-shaped and includes a first power contact 21 and a second power contact 22 essentially symmetrical with each other. The first power contact 21 includes a first contacting portion 211 and a first retaining portion 212 perpendicular to the first contacting portion 211. The second power contact 22 includes a second contacting portion 221 and a second retaining portion 222 perpendicular to the second contacting portion 221. The first contacting portion 211 and the second contacting portion 221 are parallel to each other. The first retaining portion 212 and the second retaining portion 222 engage with and overlap each other along the front-to-back direction B-B. Each of the first contacting portion 211 and the second contact portion 221 includes a pair of upper and lower slant beams 23 which are cantilevered and extend toward the first and the second retaining portions 212, 222. Besides, the first retaining portion 212 defines a first hole (not shown) and an extension 24 extending inwardly along the back-to-front direction. The extension 24 defines a column cavity (not shown) in communication with the first hole. The second retaining portion 222 defines a second hole 223 in alignment with the first hole and the column cavity. Although the first hole and the column cavity are shown clearly shown, it is understandable to those of ordinary skill in the art that the positions of such first hole and such column cavity are corresponding to the fastening member 28 extending therethrough.

The first power contacts 21 and the second power contacts 22 are linked by a plurality of fastening members 28 so as to form the power contact groups 20. The fastening members 28 are separately made from the power contact groups 20. Each fastening member 28 is a screw according to the illustrated embodiment of the present invention. The fastening member 28 includes a head 281 and a screw portion 282 extending from the head 281 along the back-to-front direction. The screw portion 282 is screwed into the second hole 223 and the first hole in turn and ultimately fastened into the column cavity. The head 281 includes a cross recess 283 for being rotatably driven by a tool (not shown) so that the screw portion 282 can be ultimately fixed to the first and the second retaining portions 212, 222. In order to reliably hold the plurality of fastening members 28, the present invention further includes a plurality of locking pieces 26 as shown in FIG. 3. Each locking piece 26 defines a round hole 261 through which the corresponding screw portion 282 extends.

Figure 6:
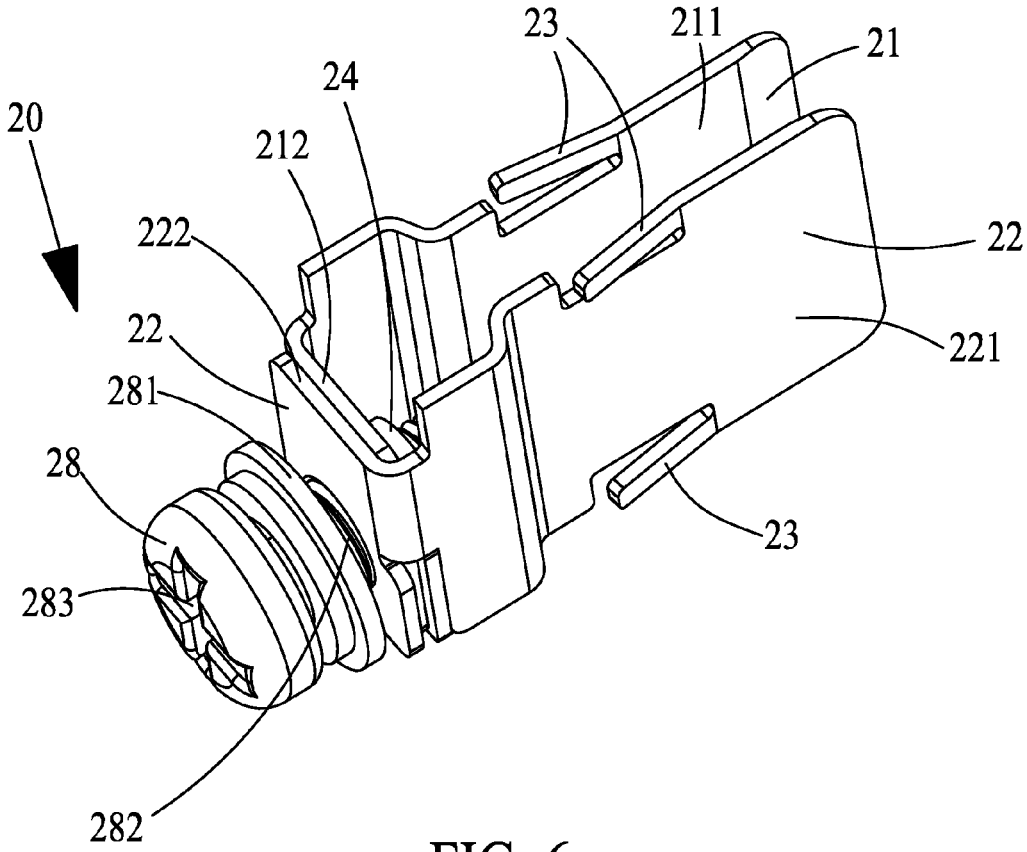
FIG. 6 is a perspective view of a power contact group and a fastening member assembled with each other.
Figure 7:
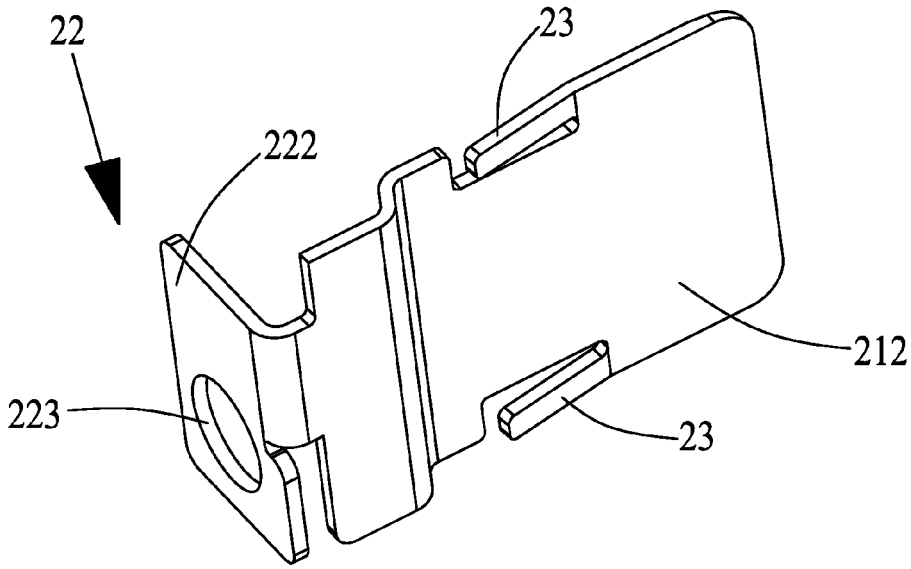
FIG. 7 is a perspective view of a power contact of the power contact group as shown in FIG. 6.

In assembling, as shown in FIG. 6, the fastening members 28 are screwed into the first and the second retaining portions 212, 222 of the first power contacts 21 and the second power contacts 22 so as to form the plurality of power contact groups 20. Each locking piece 26 is sandwiched between the second retaining portion 222 and the head 281. That is to say, each head 281 resists against the second retaining portion 222 through the locking pieces 26. Then the plurality of power contact groups 20 are inserted into corresponding grooves 11 of the insulative housing 10 along the back-to-front direction. The first and the second contacting portions 211, 221 are essentially located adjacent to the inner side walls 103. The blocks 15 on the inner side walls 103 engage against corresponding first and second contacting portions 211, 221 for holding the corresponding first and the second contacting portions 211, 221. Besides, the heat-dissipation gaps formed between each first and the second contacting portions 211, 221 and the neighboring inner side walls 103 help dissipating heat. Front ends of the first and the second contacting portions 211, 221 are stopped by the guiding blocks 17 so as to avoid over-insertion. The upper and the lower slant beams 23 of the first and the second contacting portions 211, 221 are positioned and retained in the upper and the lower positioning slots 104, 105, respectively, so that the first and the second contacting portions 211, 221 can be prevented from escaping the insulative housing 10.

Figure 8:
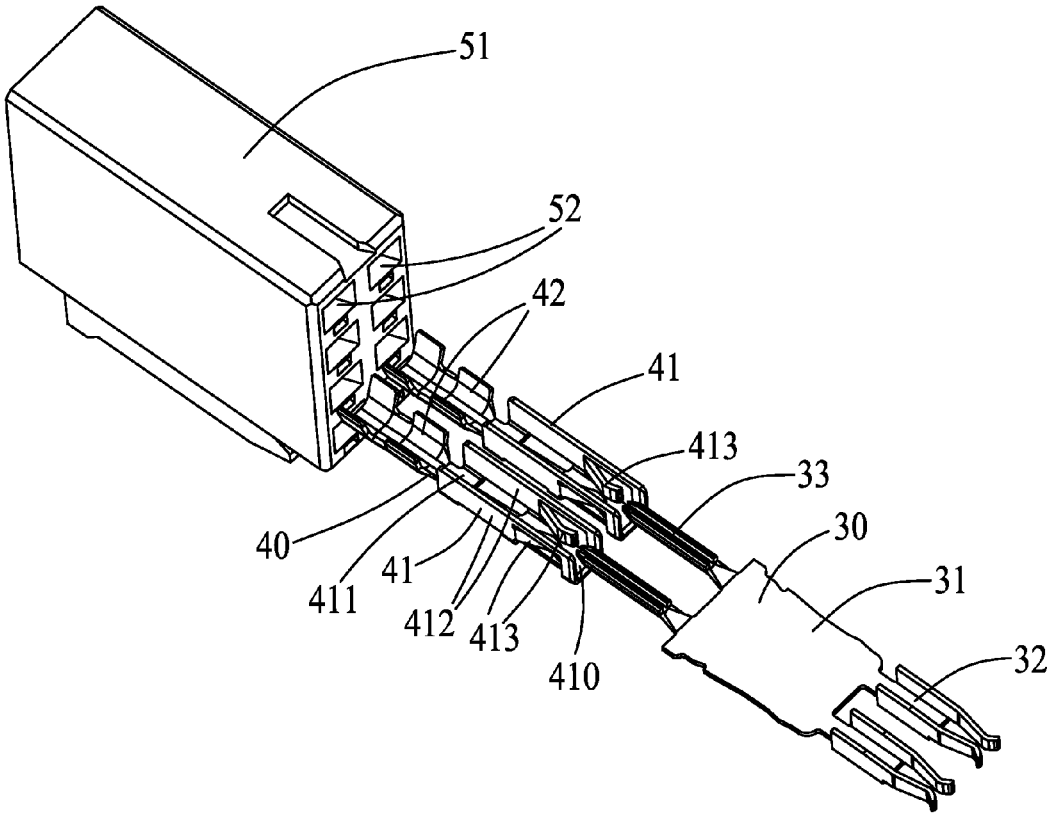
FIG. 8 is a perspective view of a terminal module showing a contact and a transfer contact separated from an insulative block.

Referring to FIG. 8, each signal contact 30 includes a plate retaining portion 31 fixed in the flat slot 121 of the passageway 12, a pair of forked contact portion 32 extending forwardly from the retaining portion 31 and a pair of tail portions 33 extending backwardly from the retaining portion 31. Each tail portion 33 is U-shaped to have larger surface for enhancing friction force. Corresponding tail portions 33 and corresponding contact portions 32 are in alignment with each other along the front-to-back direction B-B.

The transfer terminal module 50 includes an insulative block 51, a plurality of contact-receiving holes 52 defined in the insulative block 51 and a plurality of transfer contacts 40 received in the contact-receiving holes 52. The contact-receiving holes 52 are arranged in a matrix manner and are in alignment with the corresponding mating holes 122 along the front-to-back direction B-B. Each transfer contact 40 includes a U-shaped portion 41 for receiving the tail portion 33 and a cable connection portion 42 extending from the U-shaped portion 41 for receiving a cable (not shown). The U-shaped portion 41 includes a bottom wall 411 and a pair of side walls 412 extending from the bottom wall 411 and jointly with the bottom wall 411 to define a receiving slot 410 for receiving the tail portion 33 of the signal contact 30. Each side wall 412 includes an elastic arm 413 protruding into the receiving slot 410. The elastic arms 413 engage with the tail portion 33 of the signal contact 30 for improving fixation force therebetween. Each elastic arm 413 extends along a direction essentially opposite to the tail portion 33. According to the illustrated embodiment of the present invention, since the tail portion 33 is U-shaped, the fixation force between the tail portion 33 and the elastic arms 413 are greatly enhanced for signal transmission reliability. Besides, from a viewpoint of manufacture, with the transfer terminal module 34, it is capable of simplifying the structure of the signal contacts and it is very effective in connector assembling. The transfer contacts 40 of the transfer terminal module 50 bridge the signal transmission of the cables and the signal contacts 30, it is understandable to those of ordinary skill in the art that the signal contacts 30 of the present invention can be either male contacts or female contacts.

It is to be understood, however, that even though numerous, characteristics and advantages of the present invention have been set forth in the foregoing description, together with details of the structure and function of the invention, the disclosed is illustrative only, and changes may be made in detail, especially in matters of number, shape, size, and arrangement of parts within the principles of the invention to the full extent indicated by the broadest general meaning of the terms in which the appended claims are expressed.

What is claimed is:

1. An electrical connector comprising:

an insulative housing defining a mating surface, a mounting surface opposite to the mating surface, a passageway extending through the mating surface and a rear cavity extending through the mounting surface, the passageway and the rear cavity being in communication with each other along a front-to-back direction;

a contact received in the passageway of the insulative housing, the contact comprising a retaining portion fixed in the passageway, a contact portion extending forwardly from the retaining portion and a tail portion extending backwardly from the retaining portion;

a plurality of power contact groups received in a plurality of grooves of the insulative housing, each groove extending through the mating surface and the mounting surface; and a transfer contact comprising a U-shaped portion for receiving the tail portion and a cable connection portion extending from the U-shaped portion for receiving a cable, the U-shaped portion comprising a bottom wall and a pair of side walls extending from the bottom wall and jointly with the bottom wall to define a receiving slot to receive the tail portion of the contact; wherein at least one of the side walls comprises an elastic arm protruding into the receiving slot, and the elastic arm engages with the tail portion of the contact for improving fixation force therebetween;

wherein each power contact group comprises a first power contact and a second power contact essentially symmetrical with each other, the first power contact comprising a first contacting portion and a first retaining portion perpendicular to the first contacting portion, the second power contact comprising a second contacting portion and a second retaining portion perpendicular to the second contacting portion, the first contacting portion and the second contacting portion being parallel to each other, the first retaining portion and the second retaining portion engaging with and overlapping each other.

2. The electrical connector as claimed in claim 1, wherein the tail portion of the contact is U-shaped so as to achieve robust friction force when the tail portion is inserted into the receiving slot.

3. The electrical connector as claimed in claim 1, wherein the elastic arm extends along a direction essentially opposite to the tail portion.

4. The electrical connector as claimed in claim 1, wherein each of the side walls comprises the elastic arm and the two elastic arms of the U-shaped portion cooperatively clamp the tail portion.

5. The electrical connector as claimed in claim 1, wherein the contact comprises two tail portions and two contact portions.

6. The electrical connector as claimed in claim 5, wherein corresponding tail portion and corresponding contact portion are in alignment with each other along the front-to-back direction.

7. The electrical connector as claimed in claim 1, further comprising an insulative block with a contact-receiving hole therein to receive the transfer contact, the insulative block being partly inserted into the rear cavity.

8. The electrical connector as claimed in claim 7, wherein the insulative housing defines a mating hole in alignment with the contact-receiving hole.

9. The electrical connector as claimed in claim 1, wherein the first retaining portion defines a first hole, the second retaining portion defines a second hole in alignment with the first hole, the electrical connector further comprises a fastening member screwed into the first hole and the second hole so as to combine the first power contact and the second power contact together.

10. The electrical connector as claimed in claim 9, wherein the first retaining portion comprises an extension extending inwardly along a back-to-front direction, the extension defining a column cavity in communication with the first hole and the second hole to tightly hold the fastening member.

11. The electrical connector as claimed in claim 10, wherein the fastening member is a screw which comprises a head resisting against the second retaining portion and a screw portion fastened to the extension.

12. The electrical connector as claimed in claim 11, further comprising a locking piece between the second retaining portion and the head, the locking piece defining a round hole through which the screw portion extends.

13. The electrical connector as claimed in claim 1, wherein each of the first contacting portion and the second contact portion comprises at least one slant beam which is cantilevered and extends toward the first and the second retaining portions.

14. The electrical connector as claimed in claim 13, wherein the insulative housing defines at least one positioning slot to receive the at least one slant beam so as to prevent the at least one slant beam from escaping the insulative housing along the front-to-back direction.

15. The electrical connector as claimed in claim 1, wherein the insulative housing defines a plurality of escaping holes extending through the mating surface under condition that at least one escaping hole is positioned between each adjacent two grooves.

16. The electrical connector as claimed in claim 15, wherein the insulative housing comprises a plurality of inner side walls between each groove and the adjacent escaping hole, at least one of the inner side walls defining a heat-dissipation slot in communication with corresponding groove and the adjacent escaping hole.

17. The electrical connector as claimed in claim 1, wherein the insulative housing comprises a pair of inner side walls to form each groove, at least one of the inner side walls comprising a block protruding into the groove, the first and the second contacting portions being essentially located adjacent to the inner side walls, the block engaging against the first contacting portion for not only holding the first contacting portion but also forming a heat-dissipation gap between the first contacting portion and the neighboring inner side wall.

18. The electrical connector as claimed in claim 1, wherein the insulative housing comprises a pair of inner side walls to form each groove and a pair of guiding blocks extending into the groove, the guiding blocks being located adjacent to the mating surface of the insulative housing and being adapted for preventing the first and the second contacting portions from being over-inserted into the groove.

* * * * *